US005227235A

United States Patent [19]

Moro et al.

[11] Patent Number: 5,227,235

[45] Date of Patent: Jul. 13, 1993

[54] COMPOSITE SOFT MAGNETIC MATERIAL AND COATED PARTICLES THEREFOR

[75] Inventors: Hideharu Moro, Funabashi; Yasuharu Miyauchi, Narita, both of Japan

[73] Assignee: TDK Corporation, Tokyo, Japan

[21] Appl. No.: 696,911

[22] Filed: May 8, 1991

[30] Foreign Application Priority Data

May 9, 1990 [JP] Japan ..... 2-119536
Apr. 30, 1991 [JP] Japan ..... 3-126850

[51] Int. Cl.[5] ..... B32B 5/16; B22F 1/00; B22F 1/02

[52] U.S. Cl. ..... 428/357; 419/35; 419/56; 419/57; 428/402; 428/403; 428/689; 428/900

[58] Field of Search ..... 428/402, 357, 900, 689, 428/403; 419/35, 56, 57

[56] References Cited

U.S. PATENT DOCUMENTS 4,320,080 3/1982 Esper et al. ..... 252/62.54
4,676,940 6/1987 Kim et al. ..... 423/345

FOREIGN PATENT DOCUMENTS 88992 9/1983 European Pat. Off. ..... 419/35
53-91397 8/1978 Japan .
58-164753 9/1983 Japan .
64-13705 1/1989 Japan .

*Primary Examiner*—Paul J. Thibodeau
*Assistant Examiner*—D. S. Nakarani
*Attorney, Agent, or Firm*—Oblon, Spivak, McClelland, Maier & Neustadt

[57] ABSTRACT

The invention provides a composite soft magnetic material which is prepared by coating soft magnetic metal particles with a high resistance soft magnetic substance, preferably by mechano-fusion, applying electricity to the coated particles in a mold cavity between punches serving as electrodes, for example, to thereby create a plasma, and thereafter further conducting electricity to effect plasma activated sintering. There is obtained a composite material which possesses both the high saturation magnetic flux density and high magnetic permeability characteristic of the soft magnetic metal and the high electric resistivity characteristic of the high resistance soft magnetic substance.

7 Claims, 3 Drawing Sheets

COMPOSITE SOFT MAGNETIC MATERIAL AND COATED PARTICLES THEREFOR

This invention relates to a composite soft magnetic material which is a useful soft magnetic material for magnetic cores and source particles therefor.

BACKGROUND OF THE INVENTION

Known soft magnetic materials for magnetic cores or the like include metal soft magnetic materials such as Sendust and Permalloy and metal oxide soft magnetic materials such as ferrite.

The metal soft magnetic materials have a high saturation magnetic flux density and high magnetic permeability, but experience great eddy current losses in a high frequency band because of low electric resistivity. They are thus difficult to use in the high frequency band.

In turn, the metal oxide soft magnetic materials provide less eddy current losses in the high frequency band because of their higher electric resistivity than the metal soft magnetic materials. However, the metal oxide soft magnetic materials are unsatisfactory in saturation magnetic flux density.

Under such circumstances, composite soft magnetic materials having high saturation magnetic flux density and magnetic permeability as well as high electric resistivity were proposed as the soft magnetic material which overcame the drawbacks of both the metal soft magnetic material and the metal oxide soft magnetic material.

For example, Japanese Patent Application Kokai No. 91397/1978 discloses a high magnetic permeability material comprising a metal magnetic material having a coating of high magnetic permeability metal oxide formed on the surface;

Japanese Patent Application Kokai No. 164753/1983 discloses a composite magnetic material prepared by mixing an oxide magnetic material powder and a metal magnetic material powder composed of an Fe-Ni base alloy and molding the mixture; and Japanese Patent Application Kokai No. 13705/1989 discloses a composite magnetic material having a saturation magnetic flux density Bs of 6.5 to 20 kG, comprising a soft magnetic metal magnetic powder having a mean particle size of 1 to 5 μm and a soft magnetic ferrite wherein the soft magnetic ferrite fills in between the metal magnetic powder particles so that the metal magnetic powder particles are independent from each other while the soft magnetic ferrite portion is continuous.

Prior art composite soft magnetic materials including the ones disclosed in the foregoing patent publications are fired by hot press sintering, vacuum sintering, and atmospheric pressure sintering processes like atmosphere sintering. The firing temperature generally ranges from about 900° to about 1200° C. and a firing time of one hour or longer is generally required.

However, metal soft magnetic materials, when held for more than one hour at elevated temperatures, are oxidized by oxygen available from the metal oxide soft magnetic materials which are, in turn, reduced. The situation remains the same even when the materials are fired in a reducing atmosphere.

Since the metal soft magnetic material and metal oxide soft magnetic material lose their own features, a composite soft magnetic material having high saturation magnetic flux density and magnetic permeability as well as high electric resistivity is no longer obtained.

SUMMARY OF THE INVENTION

An object of the present invention is to provide a composite soft magnetic material having high saturation magnetic flux density and magnetic permeability as well as high electric resistivity and to provide a source material for preparing the same.

This and other objects are attained by a composite soft magnetic material comprising a particulate soft magnetic metal and a high resistance soft magnetic substance which are subjected to plasma activated sintering. In a preferred embodiment, the soft magnetic metal particles are coated with the high resistance soft magnetic substance prior to plasma activated sintering. Also preferably, the soft magnetic metal particles have a mean particle size of 5 to 70 μm, and the coating of the high resistance soft magnetic substance has a thickness of 0.02 to 10 μm.

Further preferably, the particulate soft magnetic metal is a mixture of smaller particles having a mean particle size of 5 to 30 μm and larger particles having a larger mean particle size of 10 to 70 μm in a weight ratio of from 1:99 to 40:6, and the coating on the smaller particles has a thickness 1.1 to 5 times that of the coating on the larger particles.

The plasma activated sintering is carried out by applying pulse current to the material under pressure to thereby create a plasma among the particles, and then conducting electricity to effect sintering under pressure. The coating is preferably provided by a mechanofusion process including applying mechanical energy to the particles. Therefore, the useful source material from which a composite soft magnetic material as set forth above is prepared is comprised of coated particles in the form of soft magnetic metal particles coated with a high resistance soft magnetic substance by mechano-fusion.

BENEFITS OF THE INVENTION

The composite soft magnetic material of the present invention is prepared by plasma activated sintering.

More particularly, soft magnetic metal particles are coated with a high resistance soft magnetic substance. Then an aggregate of the coated particles is situated in a plasma. Charged particles such as gas ions and electrons generated by electric discharge bombard the contact between coated particles for cleaning. With the aid of evaporation of the material at the contact, strong bombardment pressure acts on the coated particle surface. As a consequence, the high resistance soft magnetic substance of the coated particles is increased in internal energy, that is, activated.

Therefore, the sintering time is reduced, for example, to about 5 minutes to complete sintering. As a result, there is obtained a composite soft magnetic material having high saturation magnetic flux density and magnetic permeability as well as high electric resistivity while preventing oxidation of the soft magnetic metal particles and reduction of the high resistance soft magnetic substance.

The composite soft magnetic material of the present invention possesses the high saturation magnetic flux density and high magnetic permeability characteristic of the soft magnetic metal and the high electric resistivity characteristic of the high resistance soft magnetic substance. Therefore, it has improved soft magnetic properties as a soft magnetic material destined for magnetic cores or the like and is successful in significantly reducing the eddy current loss at the high frequency band as compared with the prior art conventional soft magnetic materials.

DETAILED DESCRIPTION OF THE INVENTION

Figure 1:
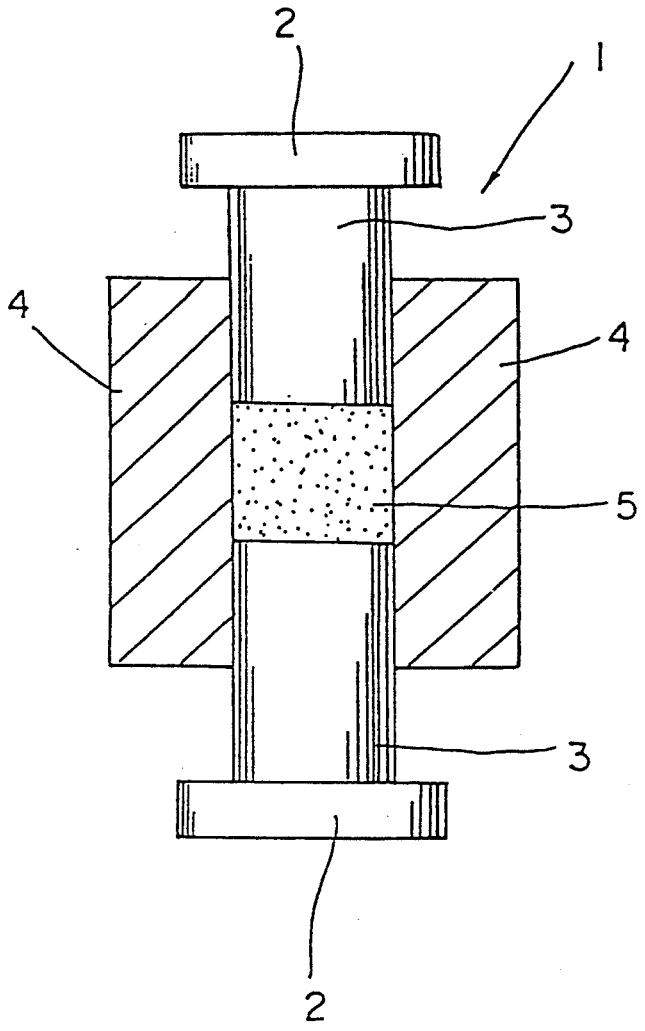
FIG. 1 is a schematic cross sectional view of a plasma activated sintering apparatus for use in the manufacture of a composite soft magnetic material according to the present invention.

The construction of the present invention will be illustrated in further detail.

The composite soft magnetic material of the present invention is prepared by coating soft magnetic metal particles with a high resistance soft magnetic substance and subjecting the coated particles to plasma activated sintering.

No particular limit is imposed on the material of the metal particles insofar as it is a soft magnetic metal. It may be either a single metal or an alloy, or a mixture thereof. It is to be noted that the soft magnetic metal is a metal having a coercive force Hc of up to about 0.5 Oe in bulk state.

Preferred metals include transition metals and alloys containing at least one transition metal, for example, Fe Al-Si alloys such as Sendust, Fe-Al-Si-Ni alloys such as Super Sendust, Fe-Ga-Si alloys such as SOFMAX, Fe-Si alloys, Fe-Ni alloys such as Permalloy and Super Permalloy, Fe-Co alloys such as Permendur, silicon steel, $Fe_2B$, $Co_3B$, YFe, $HfFe_2$, $FeBe_2$, $Fe_3Ge$, $Fe_3P$, Fe-Co-P alloys, Fe-Ni-P alloys and the like.

As to magnetic properties, the metals preferably have a saturation magnetic flux density Bs of 7 to 17 kG, a coercive force Hc of 0.002 to 0.4 Oe, and an initial magnetic permeability $\mu i$ in DC mode of 10,000 to 100,000 as measured on a bulk body.

The use of such metals and alloys leads to improved soft magnetic properties as typified by a high saturation magnetic flux density.

The soft magnetic metal particles used preferably have a mean particle size of 5 to 70 $\mu$m. Below this range, the metal is rather prone to oxidation and thus tends to lose magnetic properties. Beyond this range, the eddy current loss in metal particles would increase and the magnetic permeability in the high frequency band would greatly lower. It is to be noted that the mean particle size is a 50% particle size $D_{50}$ at which in the histogram of particle size measured by a laser scattering method, the accumulative weight of particles having the smallest to larger size reaches 50% of the total weight.

The soft magnetic metal particles preferably have two or more peaks in the particle size histogram. Particularly, a mixture of smaller particles having a mean particle size of 5 to 30 $\mu$m and larger particles having a larger mean particle size of 10 to 70 $\mu$m, especially 30 to 70 $\mu$m in a weight ratio of from about 1:99 to about 40:6 has an increased packing density with attendant advantages as will be described later.

Also, no particular limit is imposed on the high resistance soft magnetic substance with which the soft magnetic metal particles are coated insofar as it has high resistance and is improved in soft magnetic properties by sintering. By the term high resistance used herein it is meant that the electric resistivity p is about $10^2$ $\Omega$-cm or higher as measured on a bulk body. With $\rho$ of less than $10^2$ $\Omega$-cm, the eddy current loss in the high frequency band is increased.

Preferred high resistance soft magnetic substances include various soft magnetic ferrites and iron nitride. Included in the soft magnetic ferrites are, for example, Li ferrite, Mn-Zn ferrite, Mn-Mg ferrite, Ni-Zn ferrite, Cu-Zn ferrite, Ni-Cu-Zn ferrite, Mn-Mg-Cu ferrite, Mg-Zn ferrite, etc. Among them, Ni base ferrites such as Ni-Zn and Ni-Cu-Zn ferrites are preferred because of improved high-frequency response. It is to be noted that the high resistance soft magnetic substances including various soft magnetic ferrites and iron nitride are generally used alone, but may be used in admixture of two or more if desired.

The high resistance soft magnetic substance used preferably has a mean particle size of 0.01 to 2 $\mu$m. Below this range, the powder is expensive to manufacture and difficult to handle and to mold. Beyond this range, it becomes difficult to control the thickness of the coating upon coating metal particles with the substance. As to magnetic properties, the substance preferably has a saturation magnetic flux density Bs of 2 to 6 kG, a coercive force Hc of 0.1 to 5 Oe, an initial magnetic permeability $\mu i$ of 1,000 to 10,000 at a frequency of 100 kHz, and an electric resistivity of $10^2$ to $10^7$ $\Omega$-cm, especially $10^5$ to $10^7$ $\Omega$-cm as measured on a bulk body.

In the practice of the present invention, the soft magnetic metal particles are preferably coated with the high resistance soft magnetic substance.

The method of coating the soft magnetic metal particles with the high resistance soft magnetic substance is not particularly limited and, for example, mechano-fusion, electroless plating, coprecipitation, organometallic chemical vapor deposition (MO-CVD) or the like may be equally used.

Among these methods, mechano-fusion is preferred because of many advantages including possible control of coating conditions and particle shape, ease of operation, formation of an even homogeneous continuous coating film, and ease of film thickness control. For the coating by mechano-fusion, particulate soft magnetic ferrite may be prepared by coprecipitation, for example.

The term mechano-fusion means a technique of applying predetermined mechanical energy, especially mechanical strain stresses to a plurality of different stock particles to give rise to mechanochemical reaction.

Exemplary of the apparatus for applying such mechanical strain stresses is a powder processing apparatus as described in Japanese Patent Application Kokai No. 42728/1988 and commercially available as a mechano-fusion system from Hosokawa Micron K.K. and a hybridization system from Nara Machine Mfg. K.K.

Figure 2:
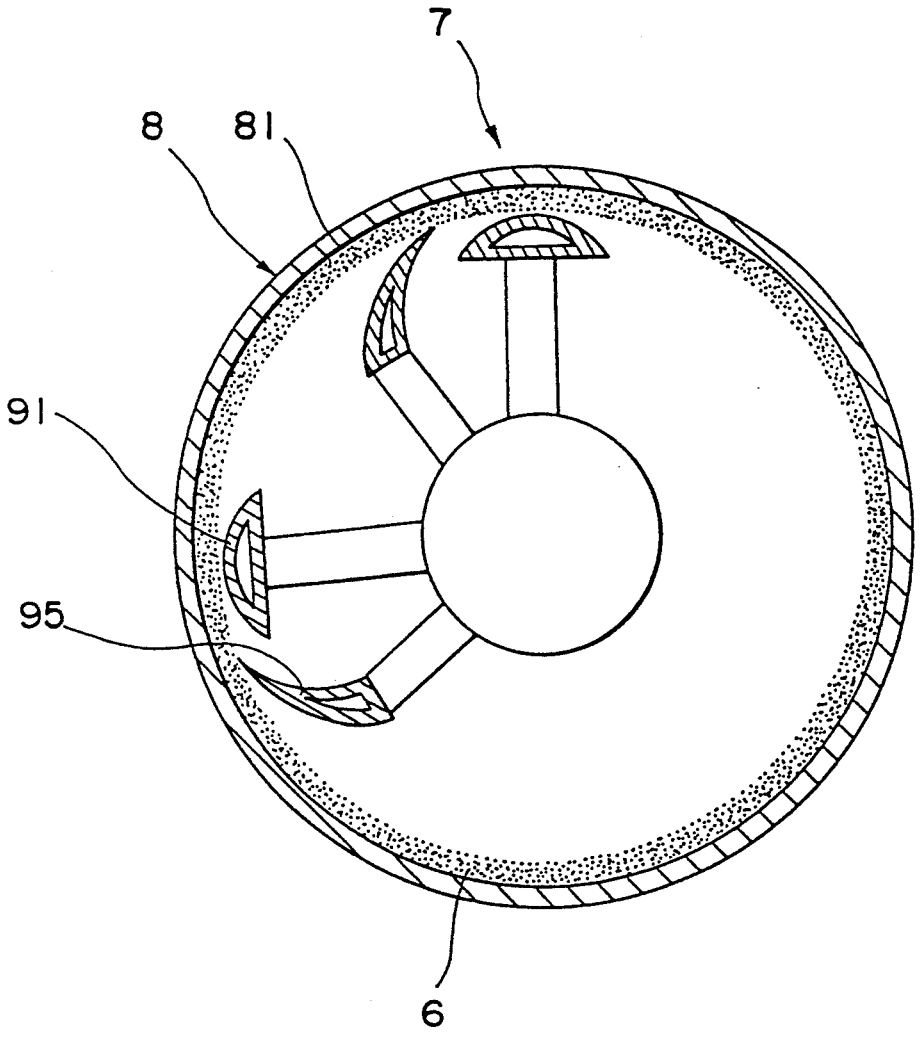
FIG. 2 is a schematic cross sectional view of one exemplary mechano-fusion coating apparatus for use in the manufacture of a composite soft magnetic material according to the present invention.

Referring to FIG. 2, there is illustrated a mechano fusion coating apparatus 7 wherein a casing 8 charged with powder is rotated at a high speed to form a powder layer 6 along the inner peripheral surface 81 thereof and friction shoes 91 and scrapers 95 are rotated relative to the casing 8, thereby causing the friction shoes 91 to apply compression and friction forces to the powder layer 6 on the inner peripheral surface 81 of the casing 8 while the scrapers 95 serve for scraping, dispersion and agitation.

The apparatus may be operated at a temperature of about 15° to 70° C. for a mixing time of about 20 to 40 minutes by rotating the casing 8 at about 800 to 2,000 rpm, while the remaining parameters remain as usual.

Alternatively, coatings of the soft magnetic substance such as ferrite can be formed by electroless plating, coprecipitation, and MO-CVD in a well-known manner as previously described.

The high resistance soft magnetic substance layer covering the surface of soft magnetic metal particles generally has a thickness of about 0.02 to 10 μm, preferably about 0.1 to 5 μm.

Where a mixture of larger particles and smaller particles in a predetermined proportion is used as the soft magnetic metal particles as previously described, preferably the coating on the smaller particles has a thickness about 1.1 to 5 times greater that of the coating on the larger particles. Then the frequency response is improved while maintaining high magnetic permeability.

Thereafter, the coated particles are subjected to plasma activated sintering to thereby form an intervening layer of the high resistance soft magnetic substance between and on the surface of soft magnetic metal particles, obtaining a composite soft magnetic material according to the present invention.

The plasma activated sintering is to place a mass of coated particles in which the soft magnetic metal particles are coated with the high resistance soft magnetic substance in plasma to thereby activate the coated particles prior to sintering.

No particular limit is imposed on the plasma creating system and the plasma activated sintering apparatus used. A plasma activated sintering apparatus 1 is illustrated in FIG. 1 as one preferred embodiment.

First, the space defined between punches 3, 3 in a mold 4 of the apparatus 1 is charged with the coated particles 5. Then the punches 3, 3 are moved toward each other to press the charge, electric current flow is supplied between electrodes 2, 2 in vacuum to generate a plasma in the charge, and then continuous current flow is supplied to effect sintering. The plasma creating current flow is generally pulse current having a pulse duration of about $20\times10^{-3}$ to $900\times10^{-3}$ sec.

This mechanism is described in further detail.

When the pulse voltage applied between the electrodes 2 and 2 reaches a predetermined value, dielectric breakdown occurs at the interface between the electrodes and the coated particles and the interface between the coated particles themselves causing electric discharge. At this point, the coated particles are fully cleaned on the surface by bombardment of electrons emitted from the cathode and ions generated at the anode. In addition, spark discharge applies impact pressures to the particles, inducing strains in the particles and enhancing the diffusion rate of atoms.

The subsequent continuous current flow generates Joule heat which spreads from points of contact and renders the high resistance soft magnetic substance on the coated particles to be prone to plastic deformation. Since atoms near the contact interfaces have been activated to a mobile state, mere application of a pressure of about 200 to 500 kg/cm$^2$ to the coated particles will bring the particles closer and cause atoms to diffuse.

Because of the presence of an electric field, metal ions are also mobile electrically.

As a result, the sintering time is reduced enough to prevent the soft magnetic metal particles from oxidation and the high resistance soft magnetic substance from reduction.

Parameters generally used for such plasma activated sintering are given below.

Press pressure: about 200 to 2,500 kg/cm$^2$
Plasma generating time: about 1 to 3 min.
Plasma atmosphere: $10^{-3}$ to $10^{-5}$ Torr
Maximum sintering temperature: about 700° to 1200° C.
Holding time at maximum temperature: about 2 to 10 min.

It should be understood that the foregoing description is merely for illustrative purposes. The atmosphere may be an inert gas such as Ar or $N_2$ gas having a controlled partial pressure of oxygen. Other parameters may be suitably chosen depending on a particular type of plasma generating system and sintering apparatus.

In the preferred practice of the present invention, the soft magnetic metal particles which have been coated with the high resistance soft magnetic substance are subject to plasma activated sintering although it is acceptable to merely mix both types of particles prior to plasma activated sintering, as the case may be.

The composite soft magnetic material of the present invention is thus obtained as a structure in which a layer of the high resistance soft magnetic substance intervenes between the soft magnetic metal particles.

Preferably, the intervening layer of the high resistance soft magnetic substance and the soft magnetic metal particles are present at a volume ratio of from about 3:97 to about 30:70. It is to be noted that the soft magnetic metal particles in the composite soft magnetic material of the invention have a mean particle size corresponding to that of the source particles, that is, of the order of 5 to 70 μm.

If a non-magnetic substance were used as the intervening layer component instead of the high resistance soft magnetic substance, the resulting composite soft magnetic material would no longer have as improved magnetic properties as the present invention because its magnetic permeability and saturation magnetic flux density are low as compared with the use of the magnetic substance.

The fact that the intervening layer has magnetism after sintering can be confirmed, for example, by spin measurement using an electron microscope or by magnetic domain observation by Bitter method.

The composite soft magnetic material of the present invention has the following properties.

Saturation magnetic flux density Bs: about 5 to 15 kG
Coercive force Hc: about 0.05 to 0.3 Oe
Initial permeability μi: about 50 to 5,000 at 100 kHz
Electric resistivity ρ: about $10^2$ to $10^7$ Ω-cm, especially about $10^5$ to $10^7$ Ω-cm The composite soft magnetic material of the present invention is a useful soft magnetic material for manufacturing magnetic cores, especially high frequency magnetic cores as well as various magnetic heads and cores destined for high density CRT.

EXAMPLE

Examples of the present invention are given below by way of illustration.

Example 1

The following soft magnetic metal particles and high resistance soft magnetic substance were furnished.

Soft magnetic metal particles

Composition (wt%): $Fe_{85}Si_{10}Al_5$
Bs: 11 kG
Hc: 0.1 Oe
$\mu i$ (DC): 30,000

High resistance soft magnetic substance

Ni-Cu-Zn ferrite (coprecipitated)
Bs: 2.8 kG
Hc: 1.0 Oe
$\mu i$ (100 kHz): 2,500
$\rho$: $10^6$ Ω-cm
mean particle size: 0.02 μm The measuring means used were a vibrating sample magnetometer (VSM) for Bs measurement, a B-H tracer for Hc measurement, an LCR meter for $\mu i$ measurement, and a four probe method for $\rho$ measurement.

The values of Bs, Hc, $\mu i$, and $\rho$ are measurements on a bulk body and in the case of high resistance soft magnetic substance, those after sintering.

Using the apparatus shown in FIG. 2, the soft magnetic metal particles were coated on the surface with the high resistance soft magnetic substance in a mechano-fusion manner to produce coated particles. The mechano-fusion coating was done by compressing and scraping the powder on the inner surface of the rotating casing at 1,500 rpm for a mixing time of 30 minutes.

Figure 3:
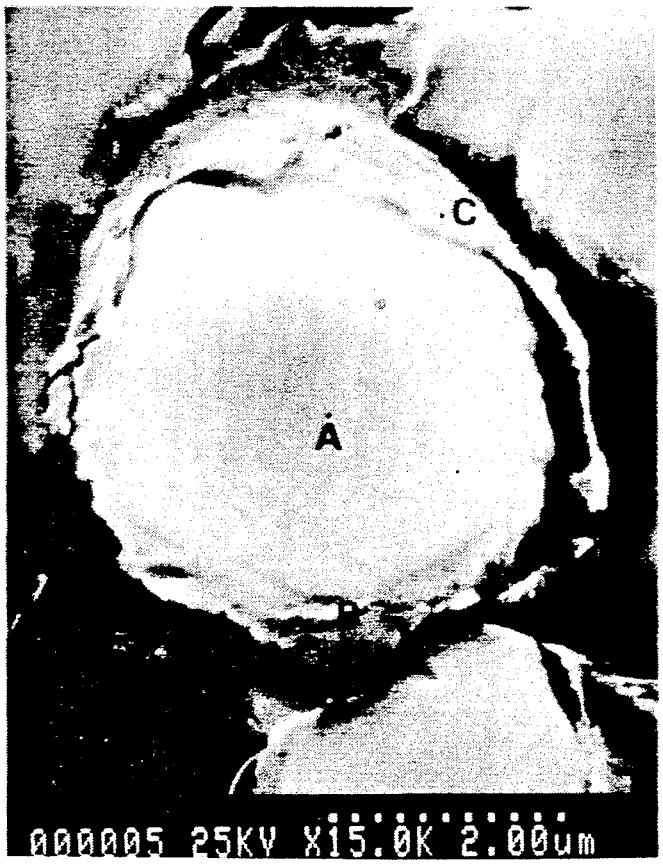
FIG. 3 is a photomicrograph showing in cross section a mechano-fusion coated particle.

The coating layer had a thickness of 0.2 μm. A cross section of one such coated particle is shown in the photomicrograph of FIG. 3. It is seen that an even and homogeneous coating was formed.

Next, using the plasma activated sintering apparatus shown in FIG. 1, plasma activated sintering was effected on the coated particle charge to produce a composite soft magnetic material (designated sample No. 1) according to the present invention.

The plasma creating system and sintering conditions are shown below.

Plasma creating system: pulse current with a pulse duration of 0.8 sec.
Press pressure: 2,000 kg/cm$^2$
Plasma generating time: 2 min.
Plasma atmosphere: $10^{-4}$ Torr
Maximum sintering temperature: 850° C.
Holding time at maximum temperature: 2 min.
Conducting DC current: 2,000 amperes
Sintering atmosphere: $5\times10^{-5}$ Torr The resulting particles of sample No. 1 were observed for magnetic domain structure on the surface, finding that the intervening layer had magnetism.

Separately, from the soft magnetic metal particles of the above-mentioned composition and magnetic properties, there were obtained two fractions having a mean particle size of 31 μm and 5 μm. The particles were mechano-fusion coated with the high resistance soft magnetic substance under the same conditions as above. The coating thickness was 0.2 μm for the fraction of larger particles having a mean particle size of 31 μm and 0.4 μm for the fraction of smaller particles having a mean particle size of 5 μm.

The larger and smaller particle fractions were mixed in a weight ratio of 9:1 and subjected to plasma activated sintering under the same conditions as above, obtaining sample No. 2.

For comparison purposes, a comparative composite soft magnetic material (designated sample No. 3) was obtained from the same mechano-fusion coated particles, but by hot press sintering. The hot press sintering conditions included a temperature of 1,000° C., a holding time of 1 hour, and a pressure of 500 kg/cm$^2$.

Further, the soft magnetic metal particles were coated with water glass to a coating thickness of 2 μm and pressed at 80° C. under a pressure of 5 t/cm$^2$, obtaining a compact (designated sample No. 4).

Sample Nos. 1 to 4 were measured for Bs, Hc, $\mu i$, and $\rho$ by the same procedures as above. The results are shown in Tables 1 and 2.

TABLE 1

| Sample No. | Bs (kG) | Hc (Oe) | $\mu i$ @ 100 kHz | $\rho$ (Ω-cm) |
|---|---|---|---|---|
| 1 (Invention) | 11 | 0.2 | 200 | $10^6$ |
| 2 (Invention) | 11 | 0.2 | 500 | $10^6$ |
| 3 (Comparison) | 7 | 1 | 60 | 5 |
| 4 (Comparison) | 5 | 2 | 60 | $10^2$ |

TABLE 2

| Sample No. | $\mu i$ at 1 kHz | 10 kHz | 100 kHz | 1 MHz |
|---|---|---|---|---|
| 1 (Invention) | 200 | 200 | 200 | 200 |
| 2 (Invention) | 500 | 500 | 500 | 500 |
| 3 (Comparison) | 160 | 80 | 60 | 10 |
| 4 (Comparison) | 60 | 60 | 60 | 60 |

The benefits of the present invention are evident from the data of Tables 1 and 2.

Toroidal magnetic cores were manufactured using sample Nos. 1 to 4. A marked eddy current loss in the high frequency band occurred in the core from sample No. 3. For the cores from sample Nos. 1 and 2, the loss at 100 kHz was less than 30% of that for sample Nos. 3 and 4.

Example 2

A composite soft magnetic material (designated sample No. 5) was prepared by the same procedure as in Example 1 including plasma activated sintering.

Soft magnetic metal particles

Composition (wt %): $Fe_{15.5}Ni_{79}Mo_5Mn_{0.5}$
Bs: 8 kG
Hc: 0.005 Oe
$\mu i$ (DC): 80,000
mean particle size: 8 μm High resistance soft magnetic substance Ni-Zn ferrite
Bs: 3 kG
Hc: 1 Oe
$\mu i$ (100 kHz): 2,000
$\rho$: $10^6$ Ω-cm
mean particle size: 0.05 μm Plasma activated sintering conditions Plasma creating system: pulse current with a pulse duration of 0.8 sec.
Press pressure: 2,000 kg/cm$^2$
Plasma generating time: 2 min.
Maximum sintering temperature: 850° C.
Holding time at maximum temperature: 3 min.

Current: 2,000 amperes
Sintering atmosphere: atmospheric air

Sample No. 5 was measured for Bs, Hc, $\mu i$, and $\rho$ by the same procedures as in Example 1. The results are shown in Table 3.

TABLE 3

| Sample No. | Bs (kG) | Hc (Oe) | $\mu i$ @ 100 kHz | $\rho$ ($\Omega$-cm) |
|---|---|---|---|---|
| 5 (Invention) | 9 | 0.1 | 1000 | $10^6$ |
| 6 (Comparison) | 7 | 1 | 120 | $10^3$ |

Also reported in Table 3 are the results of sample No. 6 which was prepared from the mechano-fusion coated particles of sample No. 5, but by hot press sintering. The hot press sintering conditions included a temperature of 1,000° C., a holding time of 1 hour, and a pressure of 500 kg/cm$^2$.

The benefits of the present invention are evident from the data of Table 3. Sample No. 5 showed a $\mu i$ of 1000 over the frequency range of from 100 kHz to 1,000 kHz.

Equivalent results were obtained with samples which were prepared from different types of soft magnetic metal particles and high resistance soft magnetic substance.

We claim:

1. A composite soft magnetic material comprising soft magnetic metal particles having a mean particle size of 5 to 70 $\mu$m and a coercive force of up to 0.5 Oe in bulk state coated with a high resistance soft magnetic substance having a thickness of 0.02 to 10 $\mu$m and an electric resistivity of $\rho$ of about $10^2$ $\Omega$-cm or higher which composition has been subjected to plasma activated sintering, wherein the plasma activated sintering comprises applying pulse current to the material for about 1 to 3 minutes under pressure of about 200 to 2500 Kg/cm$^2$ and under atmosphere of $10^{-3}$ to $10^{-5}$ Torr to create a plasma among the particles, and then conducting electricity through the material of about 1500 to 3000 amperes to effect sintering under said pressure.

2. The composite soft magnetic material of claim 1 wherein said soft magnetic metal particles comprise a mixture of smaller particles having a mean particle size of 5 to 30 $\mu$m and larger particles having a larger mean particle size of 10 to 70 $\mu$m in a weight ratio of from 1:99 to 40:6.

3. The composite soft magnetic material of claim 2 wherein the coating on the smaller particles has a thickness 1.1 to 5 times that of the coating on the larger particles.

4. The composite soft magnetic material of claim 1 wherein the coating is done by a mechano-fusion process including applying mechanical energy to the particles.

5. Coated particles from which a composite soft magnetic material as set forth in claim 1 is prepared, comprising soft magnetic metal particles coated with a high resistance soft magnetic substance by mechano-fusion.

6. The composite soft magnetic material of claim 1 having the following properties:

Saturation magnetic flux density Bs: about 5 to 15 kG
Coercive force Hc: about 0.05 to 0.3 Oe
Initial permeability $\mu i$: about 50 to 5,000 at 100 kHz
Electric resistivity $\rho$: about $10^2$ to $10^7$ $\Omega$-cm.

7. The composite soft magnetic material of claim 6, wherein the electric resistivity $\rho$ is about $10^5$ to $10^7$ $\Omega$-cm.

* * * * *

UNITED STATES PATENT AND TRADEMARK OFFICE

CERTIFICATE OF CORRECTION

PATENT NO. : 5,227,235

DATED : July 13, 1993

INVENTOR(S) : HIDEHARU MORO ET AL

It is certified that error appears in the above-identified patent and that said Letters Patent is hereby corrected as shown below:

Column 10, claim 1, line 5, after "pressure" insert --at about 700 to 1200°C and holding for about 2 to 10 minutes--

Signed and Sealed this

Twenty-second Day of March, 1994

*Attest:*

Bruce Lehman

BRUCE LEHMAN

*Attesting Officer*

*Commissioner of Patents and Trademarks*